US006892744B2

(12) United States Patent
Feldpausch et al.

(10) Patent No.: US 6,892,744 B2
(45) Date of Patent: May 17, 2005

(54) COLLAPSIBLE SHELTER STRUCTURE

(76) Inventors: Thomas G. Feldpausch, 1824 Center Rd., Hastings, MI (US) 49058; Michael J. Feldpausch, 5550 Woodschool Rd., Hastings, MI (US) 49058; Stephen J. Feldpausch, 2850 Buehler Rd., Hastings, MI (US) 49058; James E. Trist, 3982 Barber Rd., Hastings, MI (US) 49058

( * ) Notice: Subject to any disclaimer, the term of this patent is extended or adjusted under 35 U.S.C. 154(b) by 380 days.

(21) Appl. No.: 09/817,551

(22) Filed: Mar. 26, 2001

(65) Prior Publication Data

US 2002/0134416 A1 Sep. 26, 2002

(51) Int. Cl.[7] ..... E04H 15/48

(52) U.S. Cl. ..... 135/146; 135/97; 135/98; 135/114; 135/123; 135/145; 135/901; 135/902

(58) Field of Search ..... 135/97, 98, 114, 135/123, 145, 146, 901, 902

(56) References Cited

U.S. PATENT DOCUMENTS

| | | | |
|---|---|---|---|
| 39,721 | A | 9/1863 | Cross |
| 137,579 | A | 4/1873 | Turner |
| 415,826 | A | 11/1889 | Turner |
| 428,697 | A | 5/1890 | Rumrille |
| 563,375 | A | 7/1896 | Heintz |
| 905,768 | A | 12/1908 | Troutman |
| 927,738 | A | 7/1909 | Malaby |
| 935,248 | A | 9/1909 | Dennis |
| 988,400 | A | 4/1911 | Stonebridge |
| 998,462 | A | 7/1911 | Burch |
| 1,129,194 | A | 2/1915 | Hanley |
| 1,219,847 | A | 3/1917 | Nettenstrom |
| 1,335,230 | A | 3/1920 | Gleeson |
| 1,546,222 | A | 7/1925 | Finlay |
| 1,666,757 | A | 4/1928 | Snyder |
| 1,728,356 | A | 9/1929 | Morgan |
| 1,730,565 | A | 10/1929 | Flintjer |
| 1,773,395 | A | 8/1930 | Garrett |
| 1,773,847 | A | 8/1930 | Nickles |
| 1,853,367 | A | 4/1932 | Mace |
| 1,856,658 | A | 5/1932 | Rummler |
| 2,159,273 | A | 5/1939 | Killinger |
| 2,167,219 | A | 7/1939 | Sankey |
| 2,512,099 | A | 6/1950 | Guenzl |
| 2,530,765 | A | 11/1950 | Greenup |
| 2,543,597 | A | 2/1951 | Peery |
| 2,594,410 | A | 4/1952 | Feldpausch |
| 2,755,009 | A | 7/1956 | Parker |
| 2,864,389 | A | 12/1958 | Smith et al. |

(Continued)

*Primary Examiner*—Carl D. Friedman
*Assistant Examiner*—Yvonne M. Horton
(74) *Attorney, Agent, or Firm*—Price, Heneveld, Cooper, DeWitt & Litton LLP

(57) ABSTRACT

A quickly erectable structure includes expandable/collapsible top and bottom assemblies that are interconnected to facilitate forming an enclosure and to facilitate taking down the enclosure. Specifically, the bottom assembly includes a plurality of interconnected X-shaped subframes that combine to form a telescoping scissor frame. The top assembly includes a plurality of inverted foldable Y-shaped subframes attached together and to a top of the telescoping scissor frame in a manner that combines the two to form a stable umbrella-like overcenter top frame attached atop the telescoping scissor frame. A drawstring mechanism is attached to a peak of the structure to hold the top frame in an expanded position. Flexible covers are attached to the two frames, and a drawstring arrangement on the top cover allows flaps to be lifted to form 360 degrees of windows.

8 Claims, 10 Drawing Sheets

U.S. PATENT DOCUMENTS 2,865,387 A 12/1958 Annibaldi
2,928,404 A 3/1960 Klages
2,967,534 A 1/1961 Silye
3,018,857 A 1/1962 Parham
3,059,658 A 10/1962 Finlayson
3,105,505 A 10/1963 Maybee
3,169,543 A 2/1965 McGerty
3,174,493 A 3/1965 Gruenberg
3,323,530 A 6/1967 Smith
3,431,924 A 3/1969 Simpson
3,480,023 A 11/1969 McConnell et al.
3,502,091 A 3/1970 Corbin
3,690,334 A 9/1972 Miller
3,709,237 A 1/1973 Smith
3,710,806 A 1/1973 Kelly et al.
3,746,386 A * 7/1973 Woodward ..... 135/88.14
3,759,277 A 9/1973 Glade
3,766,932 A 10/1973 Sidis et al.
3,874,397 A 4/1975 Oberhaus
3,913,598 A 10/1975 Glutting, Jr. et al.
3,929,146 A 12/1975 Maiken
4,067,346 A 1/1978 Husted
4,070,722 A 1/1978 Sutherland
4,186,912 A 2/1980 Byrd, Jr.
4,195,651 A 4/1980 Watts et al.
4,202,363 A 5/1980 Watts et al.
4,227,542 A 10/1980 Bonfilio
4,407,319 A 10/1983 Shultz et al.
4,558,713 A 12/1985 Hagler et al.
4,632,138 A 12/1986 Irwin
4,685,484 A 8/1987 Moneta
4,723,371 A 2/1988 Williams
4,761,908 A 8/1988 Hayes
4,777,755 A 10/1988 Colburn
4,779,635 A 10/1988 Lynch
4,794,717 A 1/1989 Horsmann
4,798,019 A 1/1989 Sury et al.
4,809,726 A 3/1989 Gillis
4,838,525 A 6/1989 Snow et al.
4,938,243 A 7/1990 Foster
4,944,322 A 7/1990 Gillis
5,010,909 A 4/1991 Cleveland
5,054,507 A 10/1991 Sparks
5,062,234 A 11/1991 Green
5,133,378 A 7/1992 Tanasychuk
5,193,602 A * 3/1993 Morales ..... 160/89
5,241,772 A 9/1993 Hall
5,269,623 A 12/1993 Hanson
5,301,706 A 4/1994 Jones
5,327,993 A 7/1994 Stark, Sr.
5,333,634 A * 8/1994 Taylor ..... 135/98
5,361,794 A 11/1994 Brady
5,377,711 A 1/1995 Mueller
5,414,950 A 5/1995 Johnson, Sr.
5,423,341 A 6/1995 Brady
5,499,646 A 3/1996 Lee
5,553,648 A 9/1996 Goharjou
5,595,230 A 1/1997 Guerra
5,628,338 A 5/1997 Stumbo
5,634,483 A 6/1997 Gwin
5,704,592 A 1/1998 White et al.
5,752,837 A * 5/1998 Palmer ..... 434/413
5,806,547 A 9/1998 Derlinga
5,813,160 A 9/1998 Thoelke
5,881,678 A * 3/1999 Morley ..... 119/496
5,937,883 A 8/1999 Camara
5,988,194 A 11/1999 Collins
6,016,823 A 1/2000 Hill
6,021,795 A 2/2000 Long et al.
6,036,249 A 3/2000 Kuntz
6,070,604 A 6/2000 Carter
6,089,247 A * 7/2000 Price ..... 135/145
6,092,792 A 7/2000 Camara
6,164,005 A 12/2000 Copeland
6,581,545 B1 * 6/2003 Foster ..... 119/482

* cited by examiner

COLLAPSIBLE SHELTER STRUCTURE

BACKGROUND

The present invention relates to quickly erectable enclosures, and more particularly relates to enclosures that visually and physically shield occupants from animals and natural elements, yet that permit easy entrance for occupants and easy visual access out of the enclosure.

There are numerous erectable tents and enclosures on the market. Nonetheless, improvements are desired. In particular, many existing tents and enclosures are difficult to erect, or at least they require some level of expertise or knowledge or a "trick" to erect them quickly. Also the orientation of tents is important when the tents are laid out on the ground, since many tents cannot be easily rotated or spun to face a different direction once they are erected. Further, the process of laying out a tent on the ground can result in the sides of the tent becoming very dirty. Some tents require that the person erecting the tent get down on their hands and knees, which may not be easy or comfortable to the user. Further, most tent structures have a multitude of loose pieces that must be kept track of, that must be found as they are needed, and that must be manipulated and attached in specific ways to successfully erect the tent. Finally, most tents are very difficult to erect/collapse in the dark or in low-light conditions.

Aside from the above, most erected tents have deficiencies that frustrate hunters and persons who like to be outside. For example, many tents have multiple windows, but the windows cannot be opened 360 degrees around a hunting blind, so that a hunter can see in all directions if he wants to. Also, it is desirable that the windows be selectively openable, so that the hunter can selectively open some sides but close other sides. Further, the windows should preferably be selectively openable to facilitate sweeping shots or still shots. Preferably, the enclosure should not be sensitive to orientation, so that any or all sides of the enclosure can be opened or closed. Preferably, the enclosure should provide a reasonably high area under its peak, so that a six-foot high occupant has enough room to stand up, but the sides should be low enough so as not to require the occupant to stand up to see out. Preferably, the components of the enclosure should be made of materials that create natural sounds when bumped together, so that animals and prey being hunted are not forewarned of the hunter's presence.

Aside from the above, a quickly erectable enclosure is desired that is made of durable well-known materials, and that is mechanically non-complex, yet that is adaptable to a wide variety of needs.

In the prior art is a fence-like hunting blind that includes a scissor frame having multiple X-shaped subframes interconnected together. A fabric is draped over or hung on the scissor frame to form a fence-like arrangement. The scissor frame can be positioned around an occupant to form a closed pen, such as a pentagon-shaped pen, so that it forms a shield 360 degrees around the occupant. However, the hunting blind does not include any top, such that an occupant is completely exposed in an upward direction. Also, the hunting blind does not include stakes for staking it to a ground surface.

Accordingly, an apparatus solving the aforementioned problems and having the aforementioned advantages is desired.

SUMMARY OF THE PRESENT INVENTION

In one aspect of the present invention, an erectable structure includes an expandable/collapsible bottom apparatus having a bottom internal frame and a flexible bottom cover supported by the bottom internal frame, the bottom apparatus being expandable to form a geometric shape having sides and being collapsible for compact storage. The structure further includes an expandable/collapsible top apparatus having a top internal frame and a flexible top cover supported by the top internal frame. The top internal frame has a plurality of radially-extending jointed frame members arranged in an umbrella-simulating arrangement. The jointed frame members are integrally attached to and supported by the bottom internal frame and have joints movable overcenter to an expanded position to form a roof over the geometric shape and movable to a collapsed position in the bottom internal frame for compact storage as a unit with the bottom apparatus.

In another aspect of the present invention, a quickly erectable structure includes an expandable/collapsible top apparatus having a top internal frame and a flexible top cover attached to and supported by the top internal frame for movement between an expanded position and a collapsed position. The top internal frame includes rigid top frame members pivotally attached together to define a peak, where the top frame members extend radially from the peak. The top internal frame further includes rigid right/lower and left/lower frame members pivotally attached to a bottom of each one of the top frame members at an overcenter joint. The right/lower and left/lower frame members form an inverted "Y" shape with the associated top frame member when in the expanded position but forming a dense stack of substantially parallel frame members when in the collapsed position, with a lower end of each right/lower frame member being pivotally attached to a lower end of the next adjacent one of the left/lower frame members so that, when expanded, the right/lower and left/lower frame members form a zigzag pattern around and spaced from the peak. A releasable support structure is operably attached to the peak and each of the top frame members for selectively holding the top apparatus in the expanded position.

In another aspect of the present invention, a quickly erectable structure includes an expandable/collapsible apparatus having a plurality of interconnected X-shaped subframes that combine to form a telescoping scissor frame, a plurality of inverted Y-shaped subframes attached together and to a top of the telescoping scissor frame that combine to form an overcenter scissor frame attached across a top of the telescoping scissor frame, and flexible covers attached to the subframes. The apparatus is positionable in a storage position where the telescoping scissor frame is collapsed into a compact cylindrical shape with the Y-shaped subframes positioned within the compact cylindrical shape, and positionable in a partially-expanded position where the telescoping scissor frame is expanded to define a self-supporting fence-like geometric wall with the Y-shaped subframes positioned within the wall but not raised up, and still further is positionable in a fully-expanded position where the Y-shaped subframes are raised above the geometric wall to define a dome over the geometric wall.

In another aspect of the present invention, a method of quickly erecting a structure includes steps of providing an expandable/collapsible bottom apparatus and an integrally attached expandable/collapsible top apparatus, the bottom apparatus including a near corner and two far corners. The method further includes grasping and throwing the far corners away from the near corner of the bottom apparatus to expand the bottom apparatus to a geometric wall shape, and still further includes grasping and lifting the top apparatus to expand the top apparatus to form a roof over the geometric shape.

In another aspect of the present invention, a method of quickly erecting a structure includes steps of providing an expandable/collapsible bottom apparatus and an expandable/collapsible top apparatus, the bottom apparatus including a frame with top and bottom edges and a side. The method further includes resting the bottom edge of the frame on a ground surface without permitting the side to contact the ground surface, and expanding the bottom apparatus to a geometric wall shape without permitting the side to contact the ground surface. The method further includes lifting the top apparatus to expand the top apparatus to form a roof over the geometric shape.

In another aspect of the present invention, a method of quickly collapsing a structure includes steps of providing an expandable/collapsible bottom apparatus and an expandable/collapsible top apparatus, the bottom apparatus including a frame with top and bottom edges and a side, the top and bottom apparatus both being in an expanded position. The method further includes lowering and collapsing the top apparatus from the expanded position where the top apparatus acts as a roof over the geometric shape to a storage position within the bottom apparatus, and collapsing the bottom apparatus from the expanded position, where the bottom apparatus forms a geometric wall shape, the bottom apparatus, when collapsed, surrounding the top apparatus.

In yet another aspect of the present invention, a quickly erectable apparatus comprises an expandable and contractible scissor frame that includes a repeating pattern of "X" subframes that are pivotally interconnected together at corners and pivoted internally at midpoints. Flexible material covers the scissor frame. The flexible material includes slots and apertures reducing an actual outer surface area on the sheet to a maximum of about 70% of a total outer surface area.

It is an object of the present invention to provide a quickly erectable enclosure that is surprisingly and unexpectedly erectable in an intuitive manner, without substantial thought or pre-training.

It is an object of the present invention to provide an erectable enclosure that can be erected without laying out the apparatus on the ground when erecting it nor when collapsing it.

It is an object of the present invention to provide an erectable enclosure that one person can easily and quickly erect and/or collapse.

It is an object of the present invention to provide an erectable enclosure that is intuitive to set up and/or collapse for storage, and that can be easily carried.

It is an object of the present invention to provide an erectable enclosure that can be erected in less than 30 seconds, and/or be collapsed in less than 30 seconds, without the need for special expertise or training.

It is an object of the present invention to provide an erectable enclosure that does not include loose pieces.

It is an object of the present invention to provide an erectable enclosure that is easy to carry, and that is about the size of a golf bag so that it fits well into a space in a vehicle intended for a golf bag.

It is an object of the present invention to provide an erectable enclosure that utilizes components so that any noises generated during erection and/or collapse are "natural" and not "metallic."

It is an object of the present invention to provide an erectable enclosure that is interconnectable with similar enclosures positioned adjacently.

It is an object of the present invention to provide an erectable enclosure that provides a gun rest when erected.

It is an object of the present invention to provide an erectable enclosure that provides a horizontally-open area that facilitates a sweeping shot when opened but that is vertically small enough to maintain a hidden position.

It is an object of the present invention to provide an erectable enclosure that can be selectively opened around all 360 degrees of the apparatus or around any portion thereof.

It is an object of the present invention to provide an erectable enclosure that is made of environmentally friendly natural materials, and that is made of durable components, yet that is adaptable to widely different needs.

It is an object of the present invention to provide an erectable enclosure that is self-supporting and free-standing, yet anchorable without separate or loose pieces.

It is an object of the present invention to provide an erectable enclosure that is easy and intuitive to erect or collapse in the dark or in low-light conditions.

It is an object of the present invention to provide an erectable enclosure that is self-supporting and free-standing, even on angled or uneven terrain, and even on snow or ice.

It is an object of the present invention to provide an erectable enclosure that provides head room under an umbrella-like top open area within enclosure, with the area under the peak providing head room up to six feet (or higher) under the peak.

It is an object of the present invention to provide an erectable enclosure that is adapted for a wide variety of needs, such as for use as a victim shield and crowd separation device at a vehicle accident site or at a ski accident site, or for use as a shielding device and containment/enclosing device at a waste hazard site or at a construction site.

It is an object of the present invention to provide a quickly erectable enclosure that provides sufficient internal room for socializing and sport, such as for use as an ice-fishing shanty, and that can be attached to other similar enclosures to create an enlarged elongated enclosure.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
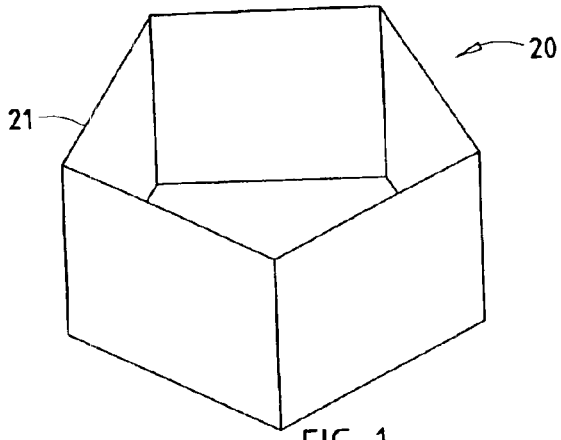
FIGS. 1–4 are perspective schematic views showing the present invention in a simplified manner to facilitate disclosure, FIG. 1 being a perspective view showing the bottom cover only in a pentagon shape, FIG. 2 showing the bottom cover in the pentagon shape and also showing the bottom scissor frame, FIG. 3 showing the structure of FIG. 2 and the angled frame members of the top apparatus, and FIG. 4 showing the top apparatus, including the angled frame members and the peak frame members joined at a center peak.

The present quickly erectable structure includes expandable/collapsible top and bottom assemblies that are interconnected to facilitate quickly to form an enclosure and to facilitate quickly taking down the enclosure without lying the structure down on a ground surface. Specifically, the bottom assembly includes a plurality of interconnected X-shaped subframes that combine to form a telescoping scissor frame. The top assembly includes a plurality of inverted foldable Y-shaped subframes attached together and to a top of the telescoping scissor frame in a manner that combines the two to form a stable umbrella-like overcenter top frame attached atop the telescoping scissor frame. A drawstring mechanism is attached to a peak of the structure to hold the top frame in an expanded position. Flexible top and bottom covers are attached to the two frames. A drawstring arrangement on the top cover allows flaps to be lifted to form 360 degrees of windows around the hunter, or a window that extends only as far as the hunter prefers.

The present structure has been found to be particularly useful as a hunting blind. For example, the top is covered by a separate fabric covering, with bottom edges of the top covering extending downwardly overlapping onto a top edge of the fabric that covers the bottom frame. A plurality of drawstrings are arranged around the top so that, by selectively pulling on the drawstrings on each side, a bottom edge of the top fabric covering can be pulled upward to form a horizontal slit having an adjustable vertical height. The horizontal slit can be open at a corner, such that a corner of the bottom frame is open and can function as a gun rest for a still shot with a gun, a hunting rifle, or bow. Alternatively, a side panel of the top covering can be drawn up, so that an elongated slit is available. This allows a hunter to perform a sweeping shot, such as at a running deer. Also, a slit can be opened up around the hunter in any direction, including 360 degrees, or any number of degrees desired.

Notably, the present blind is made out of wood dowel, which has proven to be very environmentally friendly. Also, the wood dowel provides a more natural sound when the frame members are bumped together during erection of the hunting blind. This is advantageous both because the hunted quarry will not be as suspicious to the sounds caused when the blind is erected, and also because the hunter will feel more unified with and blended into the hunting area, thus reassuring the hunter.

The present apparatus is also useable as a visual shield and as a shield for protecting an injured person from natural elements, such as at a vehicle accident site. The present apparatus is particularly useable in this manner since it can be quickly set up, almost without thought. Access to the victim can be provided by opening a corner of the apparatus in the direction desired. Further, air and ventilation can be provided by opening the "windows" of the top portion at any location 360 degrees around the top (i.e., the top is covered by a fabric with edges located about 3 to 4 feet high, which edges can be raised along any portion of the top by pulling on drawstrings attached to the peak of the apparatus and to the top fabric edges).

As described below, the apparatus can be set up by pulling it out of its carrier sleeve (if a carrier sleeve is used), thrown outward to erect the bottom portion, and lifted to erect the top portion. It is estimated that a user can fully erect the present apparatus within about 30 seconds (or less) without substantial effort or expertise. The erection does not require that the apparatus be laid out on the ground, neither during erection nor for collapsing it for storage. The present apparatus not only provides a side shield for blocking visual access to the accident victim, but also provides a top cover and side/top enclosure for shielding the victim from natural elements. It is noted that vehicle accidents often occur when precipitation is falling, such as rain, sleet, snow, and the like. The present structure is perfect for such situations, particularly since it is self-supporting and free-standing. It is noted that the apparatus does not include loose pieces, such that all components are attached and where they need to be for use. For example, the ground stakes include a looped end rotatably attached to a bottom of the bottom frame. The ground stakes can be left in a non-use storage position, or they can be released and pivoted to a downward orientation for engagement into a soil or ground surface.

Testing has shown that the present apparatus is excellently suited to be used as a screen and victim shield for skiing accidents and/or snowmobile accidents. In addition to the above characteristics, the present apparatus is self-supporting and free-standing even when erected on a ski slope or angled terrain. The stakes are rotatably attached where they will not be lost, yet where they are easily freed and orientable for use. When used for ski or vehicle accidents, the fabric can be brightly colored for maximum visibility. Also, the roof can be removed and the base portion used to divert ski traffic or to perform "crowd control". Also, the fabric can be any suitable material. For example, in ski accidents, testing has shown that an apertured fabric with about 30% to 70%, or more preferably about 50%, of the side surface being elongated slits and holes are effective to break the wind, knock down the snow, and provide a shelter that is most effective for a victim who is very warmly dressed. In effect, a fabric is provided that is analogous to a snow fence or wind break, as are often used to control snow drifts along highways and roads. Also, the open areas in the fabric sides lets some wind pass to help keep the structure upright. For example, the apertures can be horizontally-elongated slots arranged in patterns around the fabric 21.

The present apparatus has also been found to provide an effective ice shanty and/or camping shelter. For ice shanties, the apparatus can be anchored by use of weights rested on the stakes, or by engaging the stakes into snow or loose ice. As an ice shanty, the present apparatus can be arranged close to other shanties, or can be clipped to adjacent shanties with the open corner forming the door being attached to and positioned adjacent to other doors. This provides easy access and a social aspect that has been found to be very advantageous and desirable to ice fishermen. Notably, the bottom frame of the present apparatus includes removable rubber connectors at each corner. This allows any corner of the apparatus to be opened up. Thus, several of the present apparatus are connected end-to-end in series, or in a curved geometric pattern, such that a long tent can be quickly and effectively made.

The present apparatus is surprisingly durable and can be used in and around dirty and messy environments, such as in inclement weather, on muddy or wet areas, or around construction. Further, the present apparatus is constructed from materials that are readily available, such that it can be easily repaired or fixed, including in-the-field repair.

FIGS. 1–5 schematically show the present collapsible apparatus as a blind 20. The FIGS. 1–5 are simplified in a manner that makes the initial shape and construction of the blind easier to describe. By reading the description of FIGS. 1–5 while viewing the later Figures, the present apparatus should be easier to understand. It is contemplated that the illustrated five-sided apparatus is particularly stable when expanded and free-standing. However, it is contemplated that the present invention includes other structures, such as ones that include three-sided, four- sided, six-sided, or that include additional sides. Notably, even though the present apparatus is described in FIGS. 1–23 as a hunting blind, the disclosure is believed to be equally applicable to other structures, such as a victim shield (e.g. for ski accidents or vehicle accidents), as an ice fishing shanty, as a tent, or as a construction enclosure for underground work or ground under repair.

Figure 2:
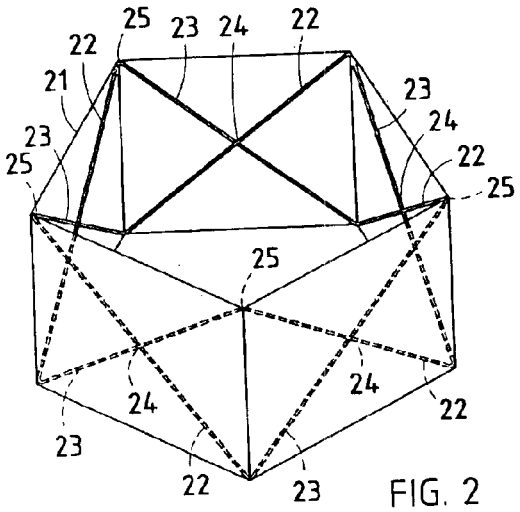

FIG. 1 shows the fabric 21 forming the five sidewalls of the present structure (more or less sidewalls can be made). (The scissor frame supporting the fabric 21 is not shown in FIG. 1.) FIG. 2 shows the fabric 21 and also shows the cross supports 22 and 23 for each side. The cross supports 22 and 23 are pivoted together on each side at a center point, such as by a rivet-like pivot pin 24 (FIG. 5), and are rotatable between a collapsed position where all cross pieces lie substantially parallel, and an expanded position where the cross pieces form a geometric fence of interconnected X-shaped side frames. This arrangement is referred to hereafter as a scissor frame 22/23. The X-shaped side frames are made of dowel, such as ¾" wood dowel that is 54" long. They are connected together by resilient rubber tube sections 25 (FIG. 5) that extend onto and frictionally engage ends of each support 22 and 23. The rubber tube sections 25 are latex tubes, 4" long and having an inside diameter of about ⅝" so that they stretch and grasp the dowels when positioned thereon. The illustrated fabric 21 is camouflage colored for maximum hiding effect. Edge flaps of the fabric 21 are wrapped around the jointure of crosspieces 22 and 23, and include snaps 26 on the top and bottom that snap around the rubber tube sections 25. By removing one of the top rubber tube sections 25 at a vertical edge of the fabric, a doorway into the device is created. Normally, all corners except one top corner include the rubber tube sections 25.

Figure 3:
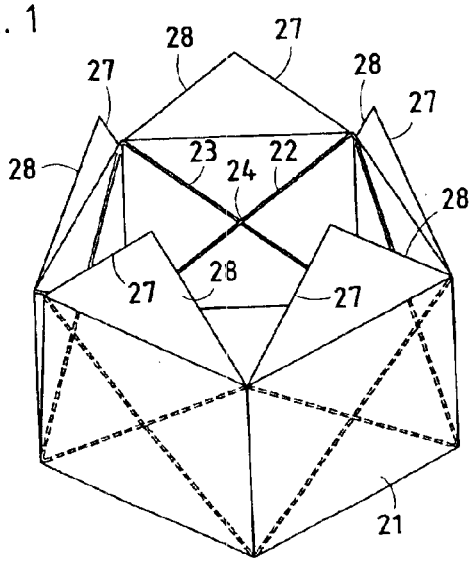
Figure 4:
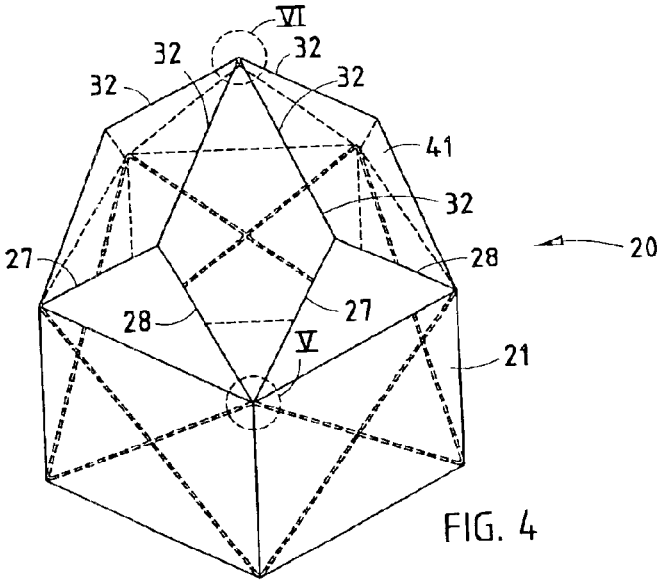
Figure 5:
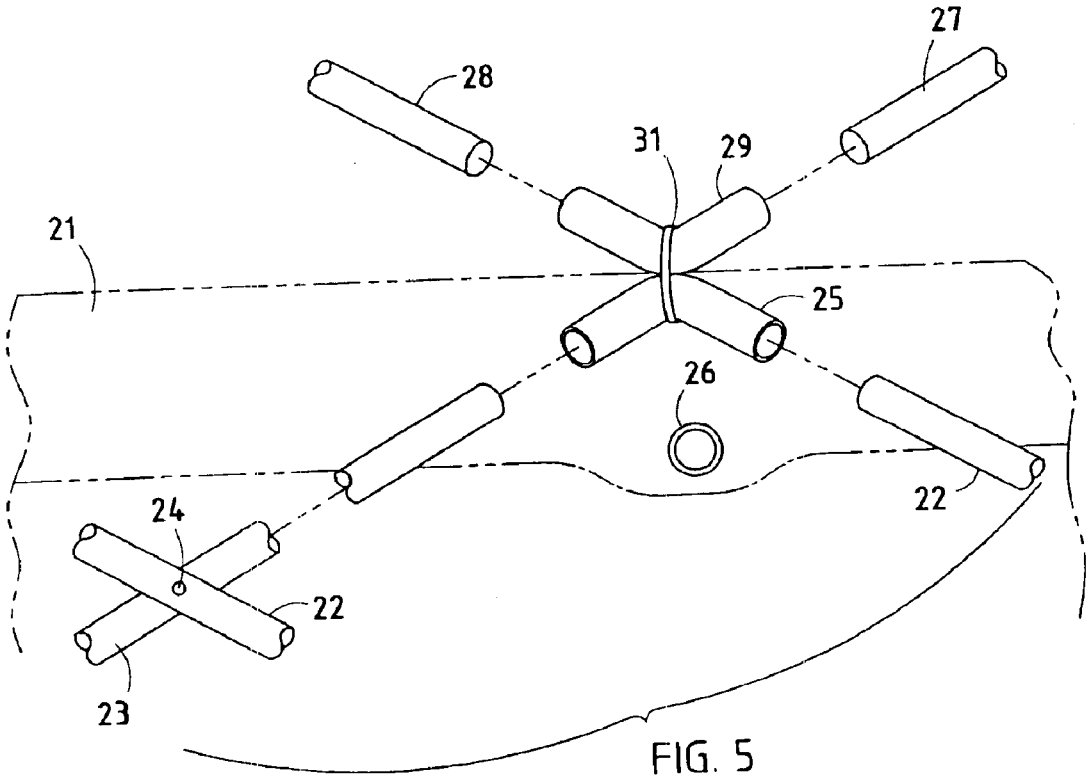
FIG. 5 is an exploded fragmentary view of the circled area 5 in FIG. 4.
Figure 6:
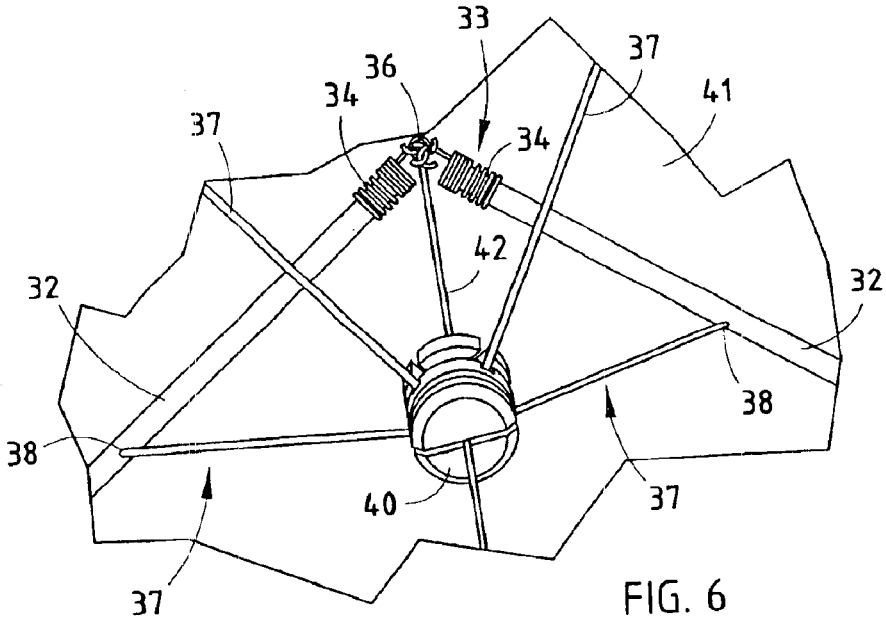
FIG. 6 is an exploded fragmentary view of the circled area 6 in FIG. 4.
Figure 10:
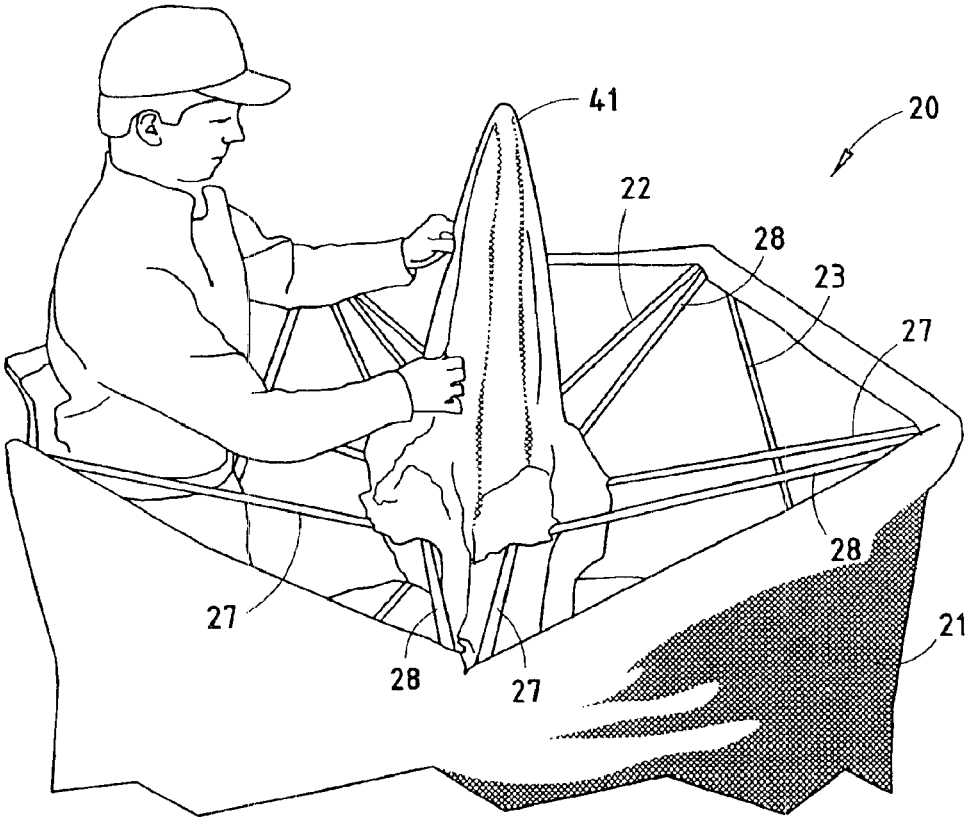
FIG. 10 is a perspective view showing the top apparatus partially raised.
Figure 11:
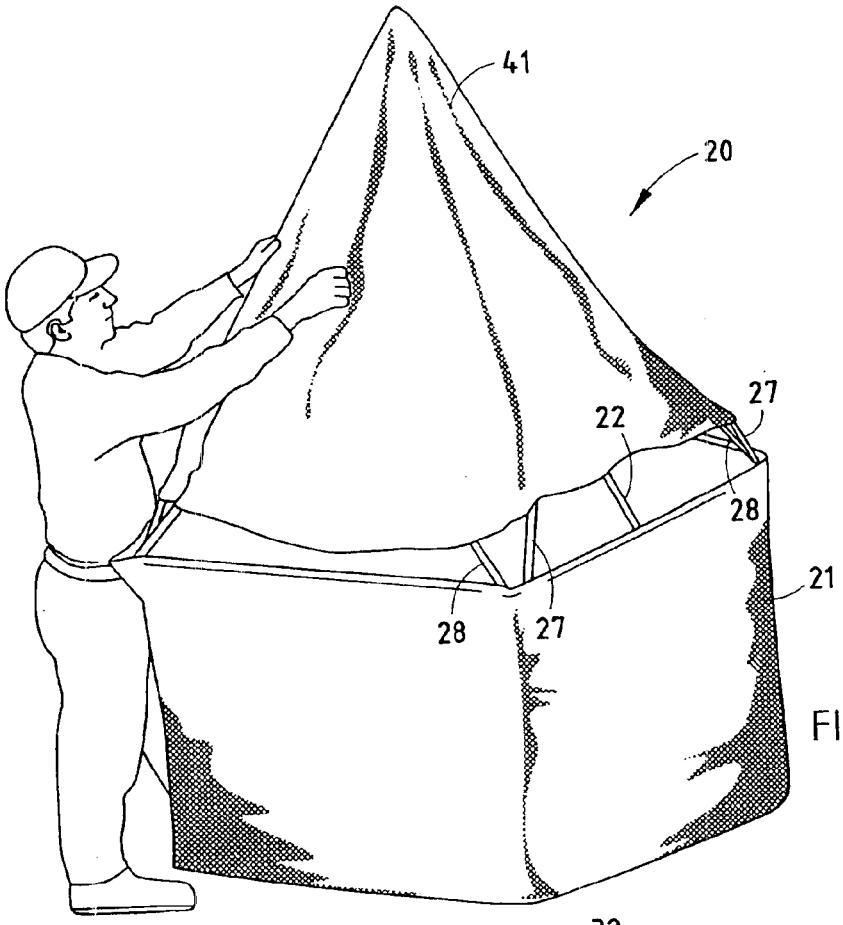
FIG. 11 is a perspective view showing the top apparatus fully raised and partially expanded (and also shows a technique of grasping a frame joint through the top flexible cover when getting ready to collapse the top apparatus)
Figure 16:
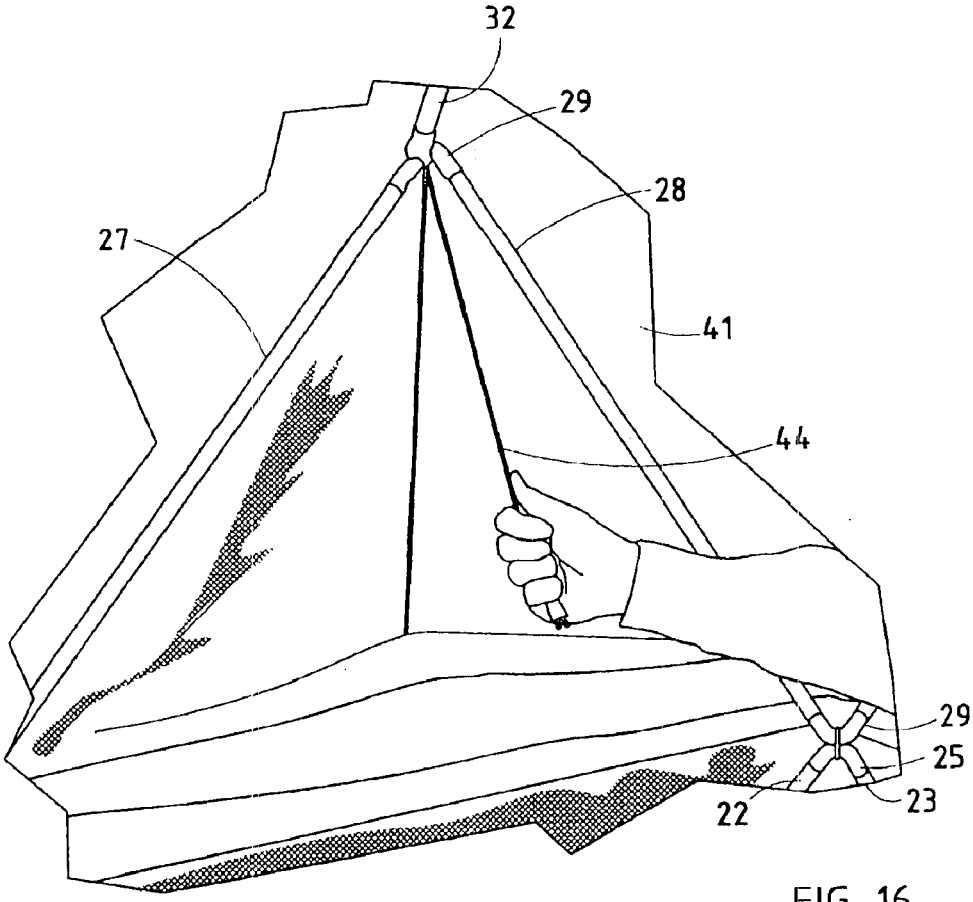
FIG. 16 is an inside perspective view of one of the window flaps and drawstrings.
Figure 17:
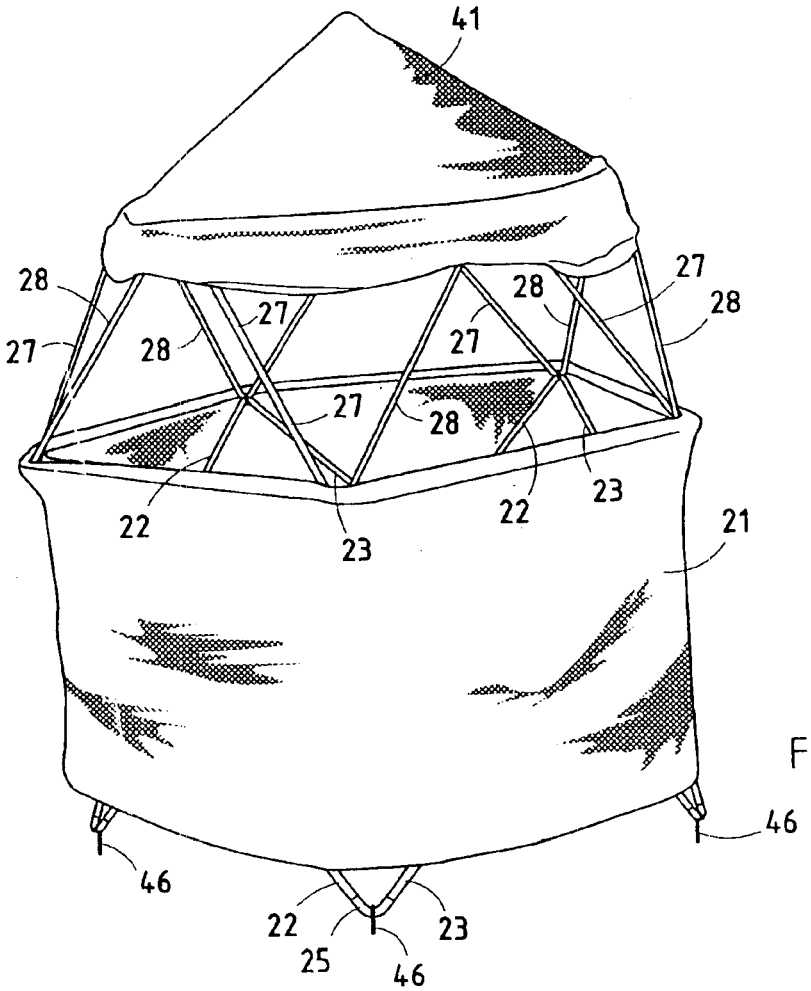
FIG. 17 is a perspective view of the erectable structure, including the top and bottom apparatus fully expanded and with all windows raised a maximum amount.

FIG. 3 is a copy of FIG. 2, but part of the top frame is added. The rest of the top frame is added in FIG. 4. The top of blind 20 includes two angled cross supports 27 and 28 on each side (FIG. 3). The bottoms of each cross support 27 and 28 on each adjacent side are connected to each other by a resilient tube section 29 (FIG. 5) and the top of each cross support 27 and 28 on the same side is connected by another resilient tube section 29. The tube section 29 connecting the bottoms of cross supports 27 and 28 is attached to a top tube section 25 on the sidewalls by a band or clip 31 (see FIGS. 5 and 16). Peak supports 32 extend from tube sections 29. Each peak support 32 includes a bottom end flexibly attached to a center of the top tube section 29 by a clip (e.g. band 31) or screw fastener (or by an bent wire member similar to piece 33), and flexibly attached at a top end with an end piece 33. (Notably, the same end piece 33 can be used on both ends of peak support 32.) The illustrated end piece 33 includes a coiled wire end 34 that fits onto and frictionally engages a top end of the dowel support 32 and a hook end 35. The hook end 35 engages a retainer ring 36. Truss members 37 are bent wires with a first end 38 pivoted to the peak support 32 a few inches (such as about 7.5") from the peak, and with an arcuate hook 39 pivoted to a hub piece 40. The supports 27, 28, and 32 are wood dowel having a diameter of ½" and a length of 29". The supports 27, 28, and 32 are interconnected at a center point by tube sections 29 (FIG. 16) to form a series of adjacent Y-shaped subframes around and under the top fabric 41, with the center point moving overcenter as the subframe is flexed between a collapsed position (FIGS. 9–10) and an expanded use position (FIGS. 11, 16, 17). In the expanded use position, the Y-shaped subframes engage and support the top fabric 41. The length of 29" has been found to be surprisingly and unexpectedly important since this length, in combination with the other lengths and in the pentagon arrangement allows the top portion to fold over-center between the storage position within the bottom scissor frame 22/23 (see FIGS. 7–8) and to the raised use position above the erected scissor frame 22/23 (see FIGS. 11, 12, and 17). It is noted that the angled supports 27 and 28 can be made of a continuous plastic strip notched at each corner to define an integral hinge, with the continuous plastic strip extending in a zigzag pattern completely around the top portion, and with every second corner being attached to the bottom scissor frame 22/23, and with the remaining corners being attached to that bottom end of the peak supports 32.

When erected, the apparatus 20 is 74" high under its peak. Further, the top is dome-shaped, such that a normal-sized man can move around under the dome-shape without striking his head on the top frame of supports 27, 28, and 32. The sidewall defined by the erected bottom frame 22/23 is about 42" high, which provides a good height for a hunter sitting down on a chair and looking out of the apparatus 20. The length of each side of the pentagon shape of the erected apparatus 20 is 36", which provides a good-sized enclosure yet is not too large.

A top fabric 41 is attached to the cross supports 27 and 28 and to the peak supports 32. In particular, the top fabric 41 includes ties or loops for attachment to the cross supports 27, 28, and 32. A center drawstring 42 extends from the center point of the top fabric 41 down through the retainer ring 36 and the hub piece 40. By tensioning the center drawstring 42, the peak is drawn down, causing the truss members 37 to press the peak supports 32 outwardly. The result is very much like when an umbrella is opened. Once pulled downwardly, the drawstring 42 can be wrapped around the hub piece 40 and frictionally engaged into a circumferential channel 42 shaped to retain the drawstring.

"Window" drawstrings 44 (FIG. 16) are attached to a lower edge of the top fabric 41 at locations equidistant between the lower ends of the top cross supports 27 and 28. A top of the drawstrings 44 are extended through end piece 33. By pulling on the drawstrings 44, the lower edge of the top fabric 41 is raised. The window thus created can be any vertical size (depending upon how far the drawstring 44 is pulled) and further can extend any length around the blind 20 or entirely around the blind an angular distance of 360 degrees. Where a sweeping shot is likely, the hunter can start near any cross support 27 or 28 and sweep along the entire side to the next cross support. Where a still shot is likely, the hunter can rest his or her gun on the crotch formed by the bottom ends of two cross supports 27 and 28.

Ground stakes (FIG. 19) can be attached to the bottom rubber tube sections 25. For example, a bent wire stake 46 includes a hooked top section 47 bent around the tube section 25, with a linear section 48. The stake 46 can be rotated to orient the linear section 48 for pressing it into the ground. When not in use, the stake 46 can be oriented parallel one of the cross supports 22 or 23 and the linear section 48 can be tucked under a rubber O-ring retainer on the cross support 22 or 23.

Figure 7:
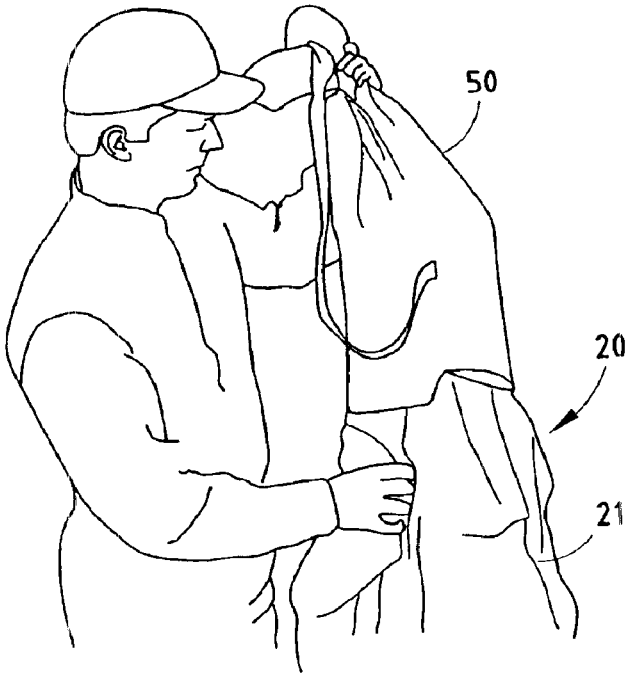
FIG. 7 is a side view of the erectable structure being pulled from a carrying case.
Figure 8:
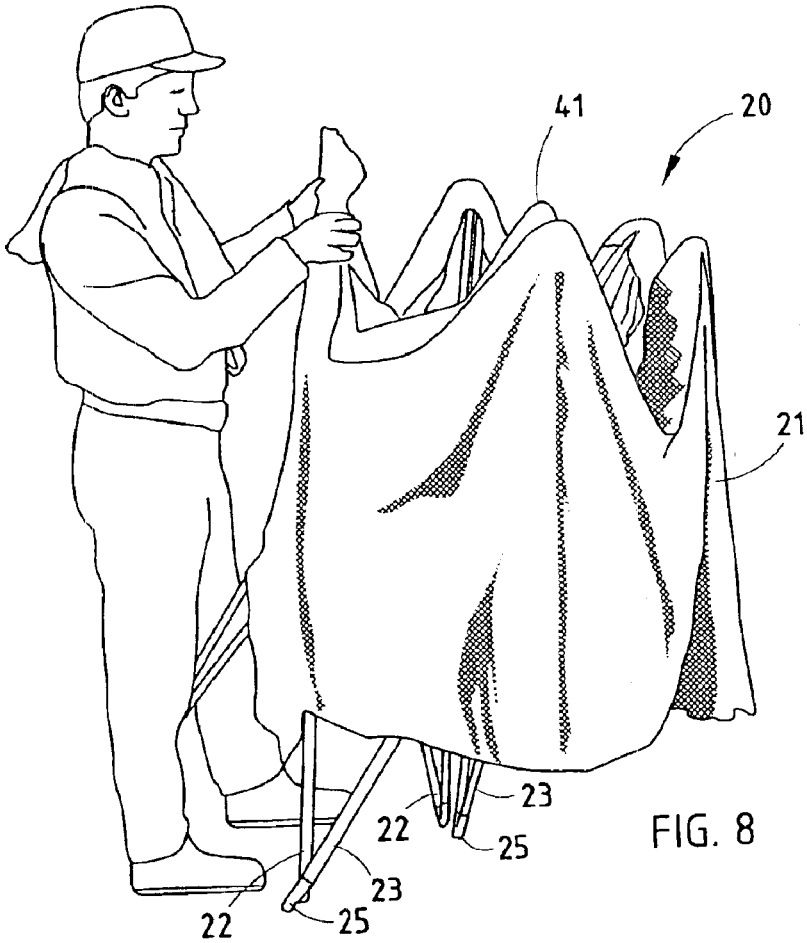
FIG. 8 is a side view of the erectable structure with the bottom apparatus partially opened expanded.
Figure 9:
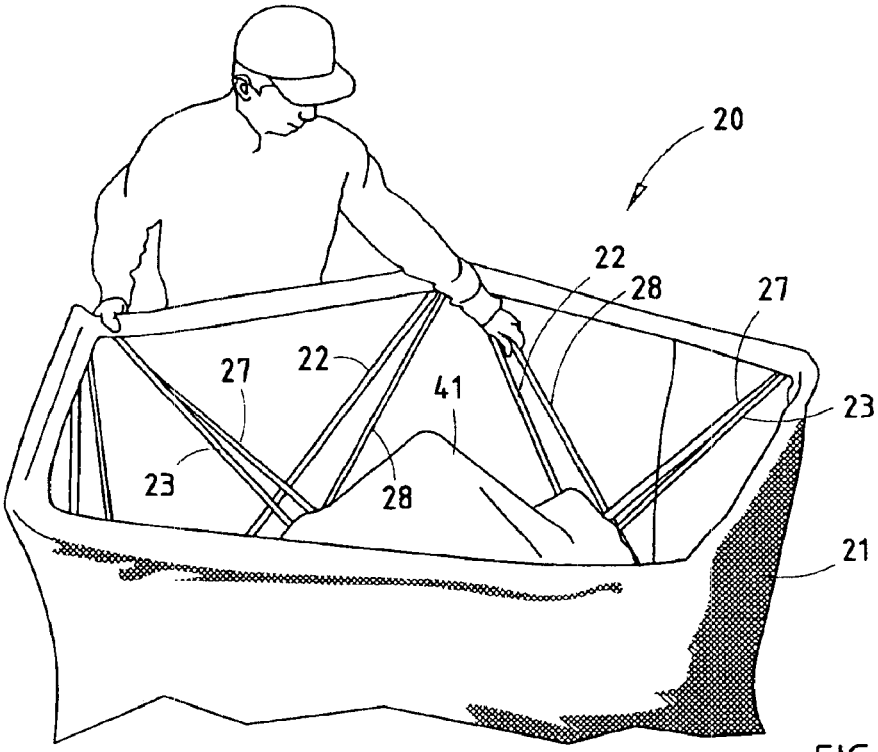
FIG. 9 is a perspective view showing the bottom apparatus fully extended and the top apparatus partially collapsed within the bottom apparatus.
Figure 12:
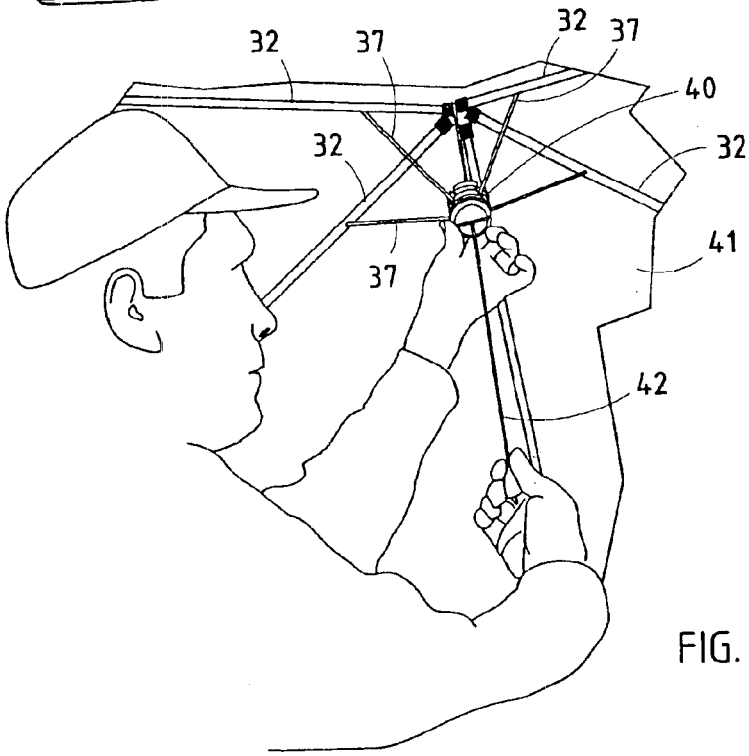
FIG. 12 is a fragmentary perspective view of an inside area of the peak of the top apparatus.
Figure 13:
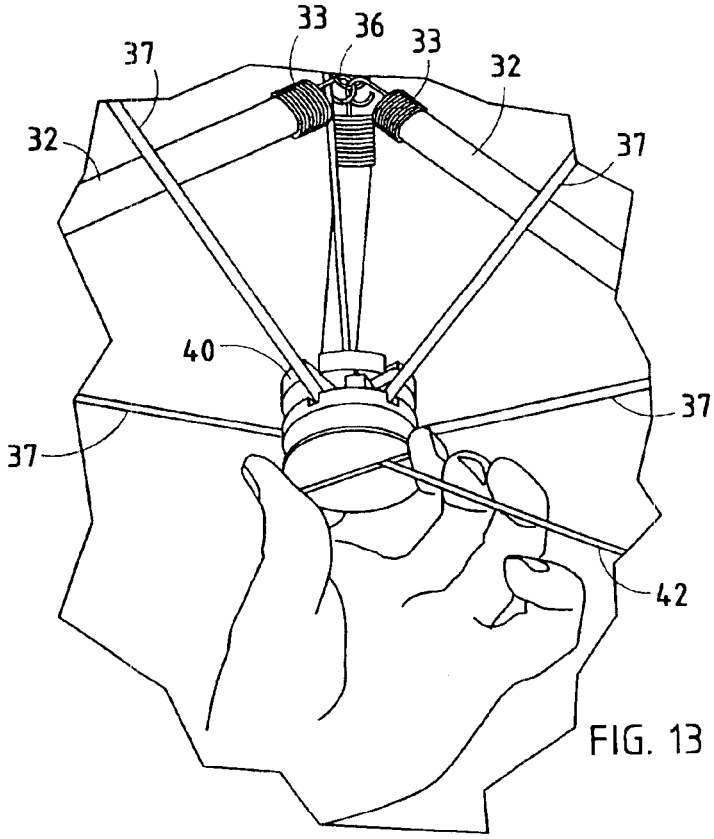
FIG. 13 is an enlarged view of the peak retainer for the peak drawstring.
Figure 14:
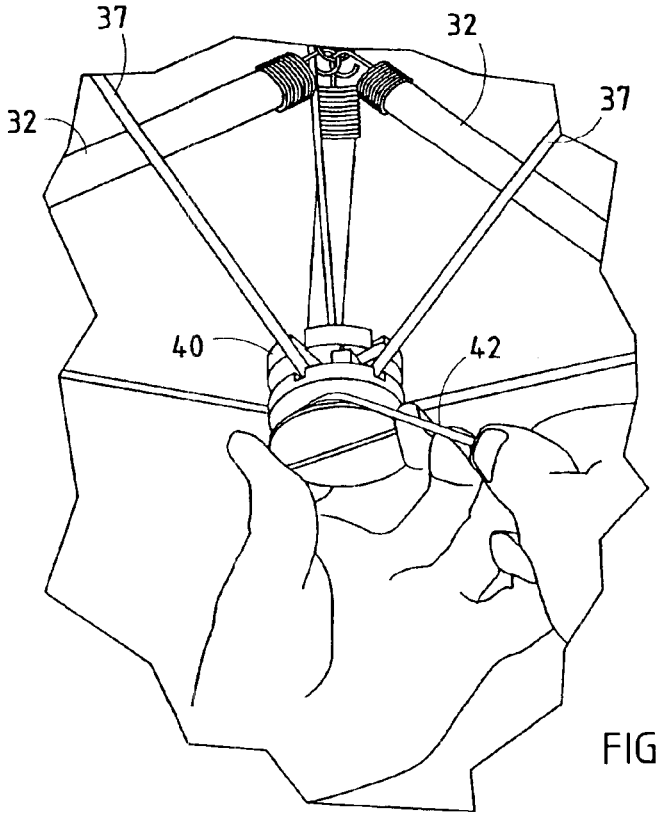
FIG. 14 is a view similar to FIG. 13, but with the drawstring virtually retained by the retainer.
Figure 15:
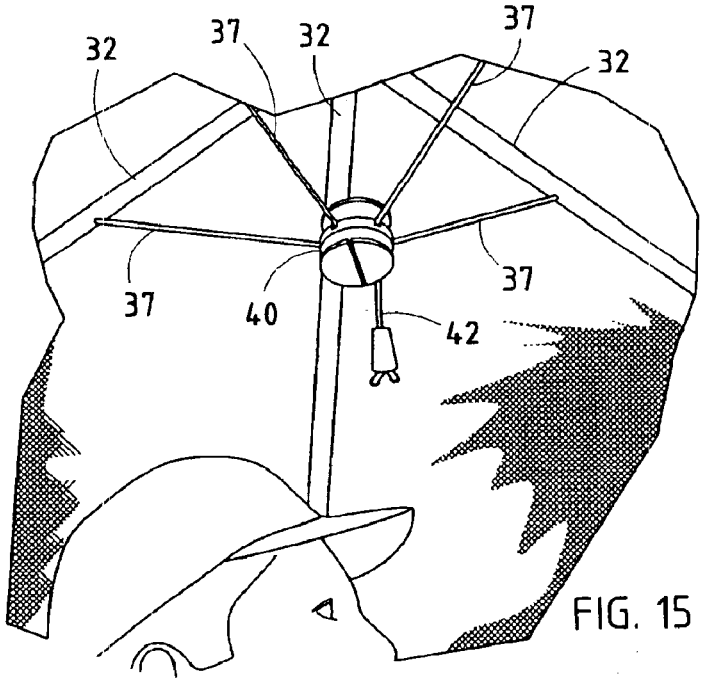
FIG. 15 is a perspective view similar to FIG. 12, but with the peak retainer frictionally holding the peak drawstring.

Notably, the blind 20 is one assembly, and there are no loose pieces. Also, it is amazingly simple to put up and take down as shown by FIGS. 7–23. FIG. 7 shows a hunter pulling the fabric carrier off of the blind 20. FIG. 8 shows a person grasping the top of two corner cross supports 22 and 23. With an up and out throwing action, the blind is literally set up in seconds with a single "throw." FIG. 9 shows stretching out the blind into its full pentagon shape, and then grasping one of the roof cross supports 27 and 28. The roof is partially raised, which stabilizes the blind 20 in its partially erected position. FIG. 10 shows a person after stepping through the doorway (at the left corner). The person grasps one of the peak supports 32 and lifts, causing the whole roof to expand and form like an umbrella (FIG. 11). Notably, FIG. 11 also shows a technique for collapsing the top, where the user grasps a lower end of adjacent peak supports 32 through the top fabric 41 and moves the top supports 32 and 27/28 overcenter. By this technique, the top apparatus "self-manages" its own collapse, which leads to a faster and more uniform/controlled collapse where the frame supports 27, 28, 32, and the flexible cover 41 consistently move to a dense, well-folded arrangement. FIG. 12 shows a person under the roof, pulling on drawstring 42 while pushing upwardly on hub piece 40 to fully expand the top. This action biases the peak supports 32 out by action of the truss members 37. FIG. 13 shows pulling the drawstring 42 sideways through a slot and in FIG. 14 the drawstring 42 is wrapped around the hub piece 40 into a friction circumferential groove so that the string tension is maintained (FIG. 15).

Figure 18:
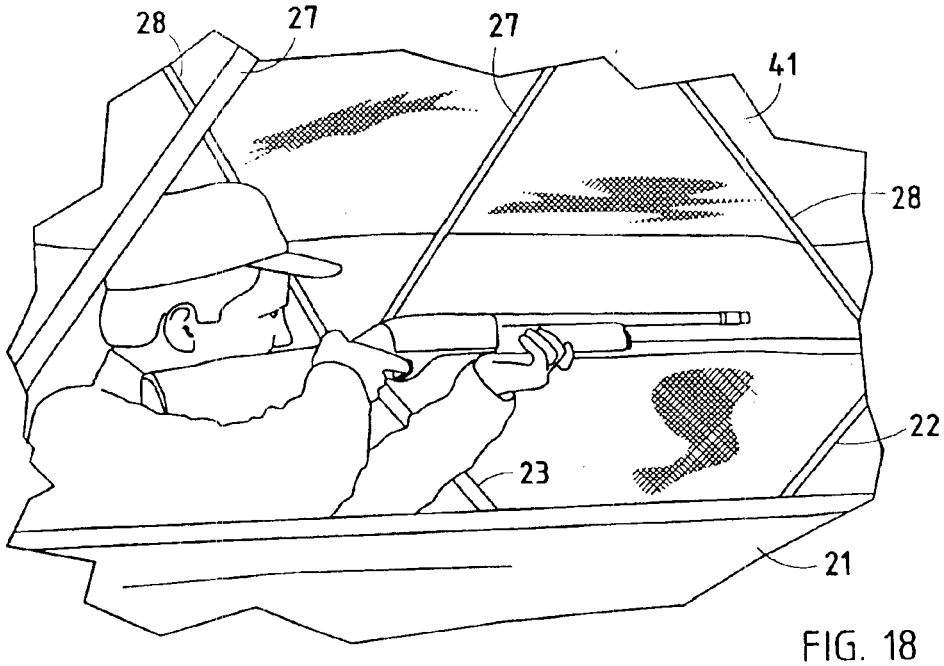
FIG. 18 is a side view of the apparatus with the windows partially open to create a horizontally elongated slot for a sweeping gun shot.
Figure 19:
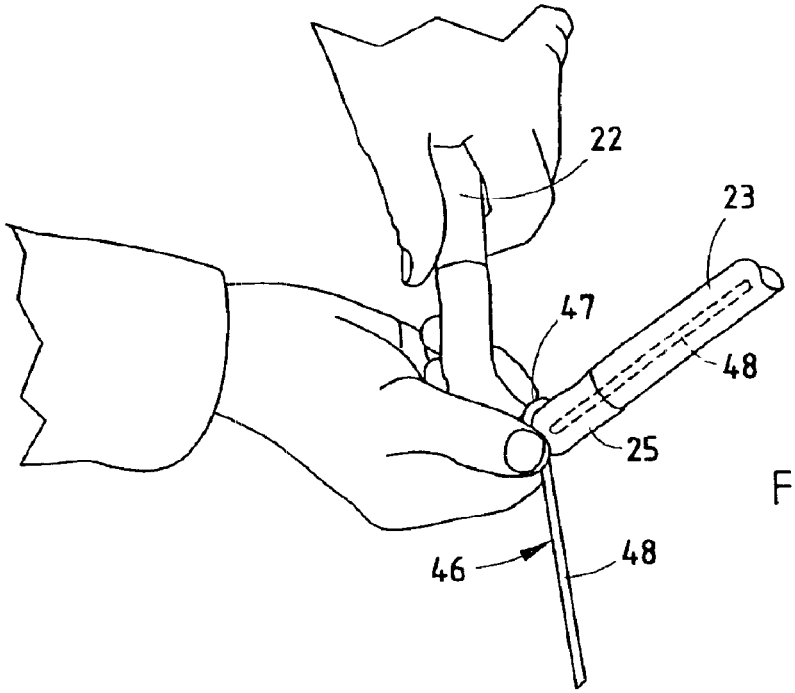
FIG. 19 is a perspective view of the bottom ends of a pair of bottom frame members, including the ground-engaging stake in a use position.
Figure 20:
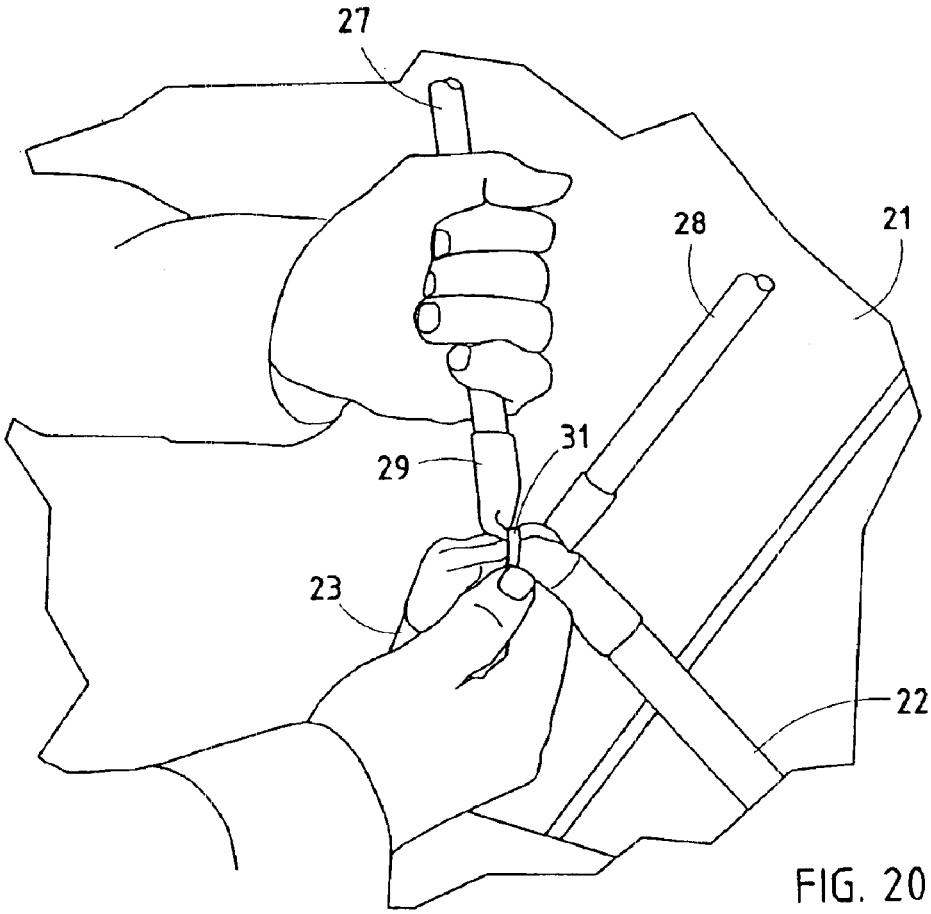
FIG. 20 is a fragmentary perspective view of a connection of the top frame members of the top apparatus to the bottom frame members of the bottom apparatus.
Figure 21:
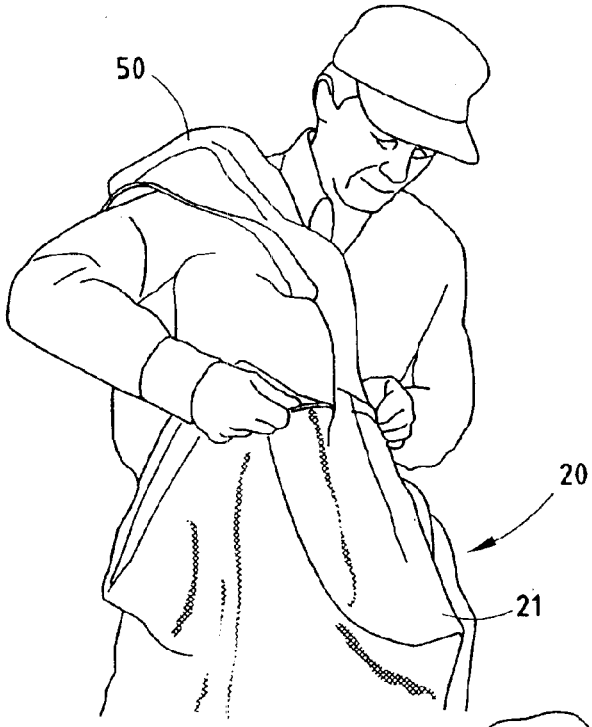
FIG. 21 is a perspective view of the carrying case being pulled onto the erectable structure after collapsing the same.
Figure 22:
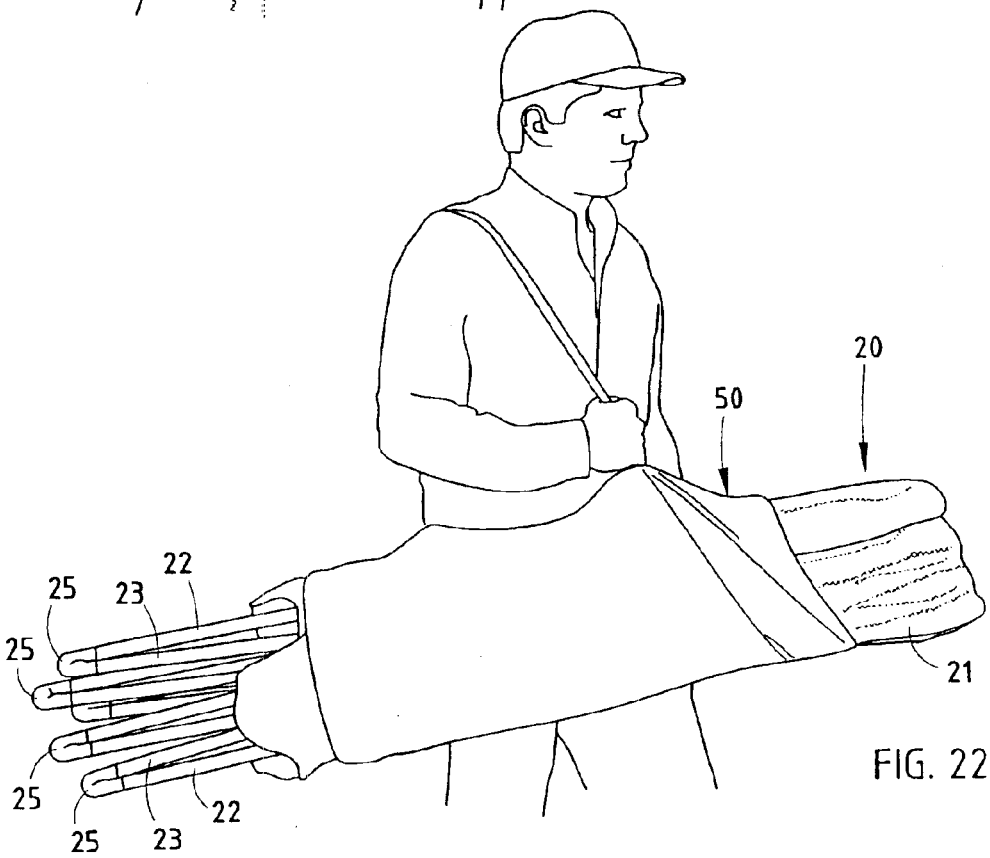
FIG. 22 is a side view of a person carrying the carrying case, including the erectable structure.

By pulling on any one of the window drawstrings 44, a window is opened anywhere around the blind 20 (FIGS. 16 and 17). In FIG. 17, the windows are fully opened. In FIG. 18, the windows are only partially opened on the side where the shot will occur. (In FIG. 18, the windows close to the camera are fully opened only for the purpose of better showing the hunter. Normally, they would be closed or only partially opened.) FIG. 18 shows that a hunter can take a sweeping shot by moving across a side. Alternatively, the hunter can rest his or her gun on the crotch formed by roof supports 27 and 28. FIG. 19 shows a stake 46 oriented to be pressed into the ground. The rubber O-ring retainer is under the hunter's hand and cannot be seen. FIG. 20 shows the band 31 that attaches the tube sections 29 and 25 together, which holds the roof on the bottom sidewall portion of the blind 20. The blind 20 collapsed very easily by reversing the above steps. It is advantageous to flatten the fabrics 21 and 41 during collapse for minimizing the folded space of the blind 20. The collapsed blind 20 can be easily slid into the tubular carrying fabric bag or sleeve/carrier 50 with shoulder strap 51 (FIG. 21). The total size and weight of the blind 20 and sleeve 50 is about the same as a golf bag. This permits the blind 20 to be easily carried (FIG. 22) and placed into a vehicle (FIG. 23).

It is contemplated that a fabric floor could be added to the blind 20 if desired, and that the floor could be wrapped around the blind 20 or tucked into the blind when the blind is collapsed. Also, it is contemplated that a folding chair could be incorporated into the blind 20 by attaching it to one of the corners of the scissor frame. The chair would include legs supported for collapsing movement, such as by a parallelogram type arrangement.

Field testing has shown that the present enclosure 20 can be advantageously used in a variety of different environments. For example, the present enclosure 20 can be easily carried by ski safety patrols. Further it provides a very effective victim shield and crowd separator. It is contemplated that in such cases the fabrics 21 and 41 will be brightly colored, and/or that a large red cross would be placed on sides of the fabric 21 to identify the apparatus 20 as a safety/accident treatment tent. Further, it is contemplated that the fabric 21 and/or the fabric 41 could include apertures or slits, thus providing protection from wintry elements but also increased ventilation for a skier who was dressed warmly. The apertured fabric also lets wind pass through, thus helping the device stay upright. It is contemplated that, when used as a victim shield, the entire roof could/would be removed in order to use the base portion as a fence. Also, this would lighten the overall weight of the enclosure 20. Still further, the supports 27, 28, and 32 could be made of light weight tubular metal. In the case of an enclosure used as a victim shield at an accident site, the enclosure 20 would also be brightly colored, so that it was easily identifiable.

The present apparatus 20 is also useable at a waste hazard site or at a construction site. The unit can be "thrown" over an area where people need to be held away, or where workers or a work area needs to be protected.

The present apparatus 20 is also useable as an ice fishing shanty, or as a tent, where sufficient space is required for movement but also where socialization is desired. It is noted that a pair of the apparatus 20 can be interconnected by placing them near each other, and then by removing one end of the top tube section 30 (and potentially also tube section 29) and connecting it (them) to the next apparatus 20. This interconnects the two apparatus 20, and further opens a doorway between the two. A resilient clip or existing snap on the fabric (not specifically shown) can also be used to hold two apparatus 20 together, so that their doorway flaps are held together.

It is to be understood that variations and modifications can be made on the aforementioned structure without departing from the concepts of the present invention, and further it is to be understood that such concepts are intended to be covered by the following claims unless these claims, by their language, expressly state otherwise.

We claim:

1. A quickly erectable structure comprising:

an expandable/collapsible top apparatus having a top internal frame and a flexible top cover attached to and supported by the top internal frame for movement between an expanded position and a collapsed position, the top internal frame including rigid top frame members pivotally attached together to define a peak where the top frame members extend radially from the peak, the top internal frame further including rigid right/lower and left/lower frame members pivotally attached to a bottom of each one of the top frame members at an overcenter joint, the right/lower and left/lower frame members forming an inverted "Y" shape with the associated top frame member when in the expanded position but forming a dense stack of substantially parallel frame members when in the collapsed position, a lower end of each right/lower frame member being pivotally attached to a lower end of the next adjacent one of the left/lower frame members so that, when expanded, the right/lower and left/lower frame members form a zigzag pattern around and spaced from the peak;

a releasable support structure attached to the peak and each of the top frame members for selectively holding the top apparatus in the expanded position; and an expandable/collapsible bottom apparatus having a bottom internal frame supporting the top apparatus, and including a flexible bottom cover supported by the bottom internal frame, the bottom apparatus being expandable to form a geometric shape having sides and being collapsible for compact storage, wherein the bottom internal frame includes a crisscrossing pattern of pivotally interconnected pairs of frame members that form repeating "X" shapes.

2. The structure defined in claim 1, wherein the top internal frame is positioned completely within the bottom internal frame when in the collapsed position.

3. The structure defined in claim 1, wherein the top and bottom apparatus are interconnected and characteristically do not include loose pieces.

4. The structure defined in claim 1, wherein the top apparatus forms a roof that is dome-shaped and outwardly concave, such that the top apparatus simulates an umbrella shape.

5. The structure defined in claim 1, wherein the top and bottom apparatus have a total height and size comparable to a golf bag when collapsed, such that the structure is adapted to be easily stored in a vehicle trunk.

6. The structure defined in claim 1, wherein the jointed frame members of the top apparatus include an intermediate joint that moves overcenter when the top frame is moved between the collapsed and expanded positions.

7. The structure defined in claim 1, wherein the bottom internal frame, when expanded, forms a free-standing, self-supporting structure that is stable, even when positioned on uneven ground.

8. An erectable structure comprising:

an expandable/collapsible bottom apparatus having a bottom internal frame and a flexible bottom cover supported by the bottom internal frame, the bottom apparatus being expandable to form a geometric shape having sides and being collapsible for compact storage; and an expandable/collapsible top apparatus having a top internal frame and a flexible top cover supported by the top internal frame, the top internal frame having a plurality of radially-extending jointed frame members arranged in an umbrella-simulating arrangement, the jointed frame members being integrally attached to and supported by the bottom internal frame and having joints movable overcenter to an expanded position to form a roof over the geometric shape and movable to a collapsed position in the bottom internal frame for compact storage as a unit with the bottom apparatus, wherein the bottom internal frame includes bottom frame members and further includes a stake pivotally attached to one of the bottom frame members and the bottom cover, the stakes being movable between a use position oriented toward a ground surface and a storage position oriented away from the ground surface, and including a holder for holding the stakes in the storage position.

* * * * *